US005251383A

United States Patent [19]

Williams

[11] Patent Number: 5,251,383

[45] Date of Patent: Oct. 12, 1993

[54] APPARATUS FOR AND A METHOD OF DISPOSING OF WET SLUDGE

[76] Inventor: Robert M. Williams, 16 La Hacienda, Ladue, Mo. 63124

[21] Appl. No.: 908,080

[22] Filed: Jul. 6, 1992

[51] Int. Cl.[5] ..... F26B 7/00

[52] U.S. Cl. ..... 34/12; 34/61; 110/224; 110/232; 241/80; 241/52; 241/48; 241/19

[58] Field of Search ..... 34/12, 60, 61; 110/232, 110/224; 241/48, 52, 79.1, 80, 19

[56] References Cited

U.S. PATENT DOCUMENTS

| | | | |
|---|---|---|---|
| 2,032,402 | 3/1936 | Colby et al. | 110/224 |
| 2,066,418 | 1/1937 | O'Mara | 110/224 |
| 2,148,447 | 2/1939 | Dundas et al. | 110/224 |
| 2,148,981 | 2/1939 | Dundas et al. | 110/224 |
| 4,498,633 | 2/1985 | Williams | 241/48 |
| 4,599,954 | 7/1986 | Williams | 110/232 |
| 4,905,918 | 3/1990 | Selles et al. | 241/79.1 |
| 4,938,155 | 7/1990 | Williams | 110/224 |

*Primary Examiner*—Henry A. Bennet
*Assistant Examiner*—Denise L. Gromada
*Attorney, Agent, or Firm*—Polster, Lieder, Woodruff & Lucchesi

[57] ABSTRACT

Apparatus for disposing of wet sludge by conversion to a substantially dry product during grinding of the wet sludge in a drying atmosphere which promotes the separation of the grindings into coarse fractions and fine fractions so that the coarse fractions in the dried condition can be directed to enter the supply of the wet sludge for reducing the moisture content to prepare the mix of wet sludge and coarse fractions for grinding in a drying heat atmosphere to perpetuate the supply of coarse fractions for moisture reduction of the wet sludge and a supply of the fine fractions as a product of the apparatus.

7 Claims, 2 Drawing Sheets

FIG. 2.
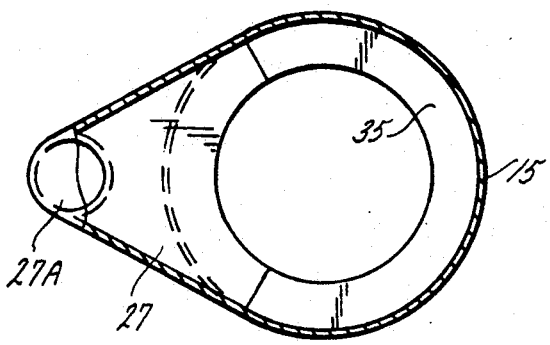
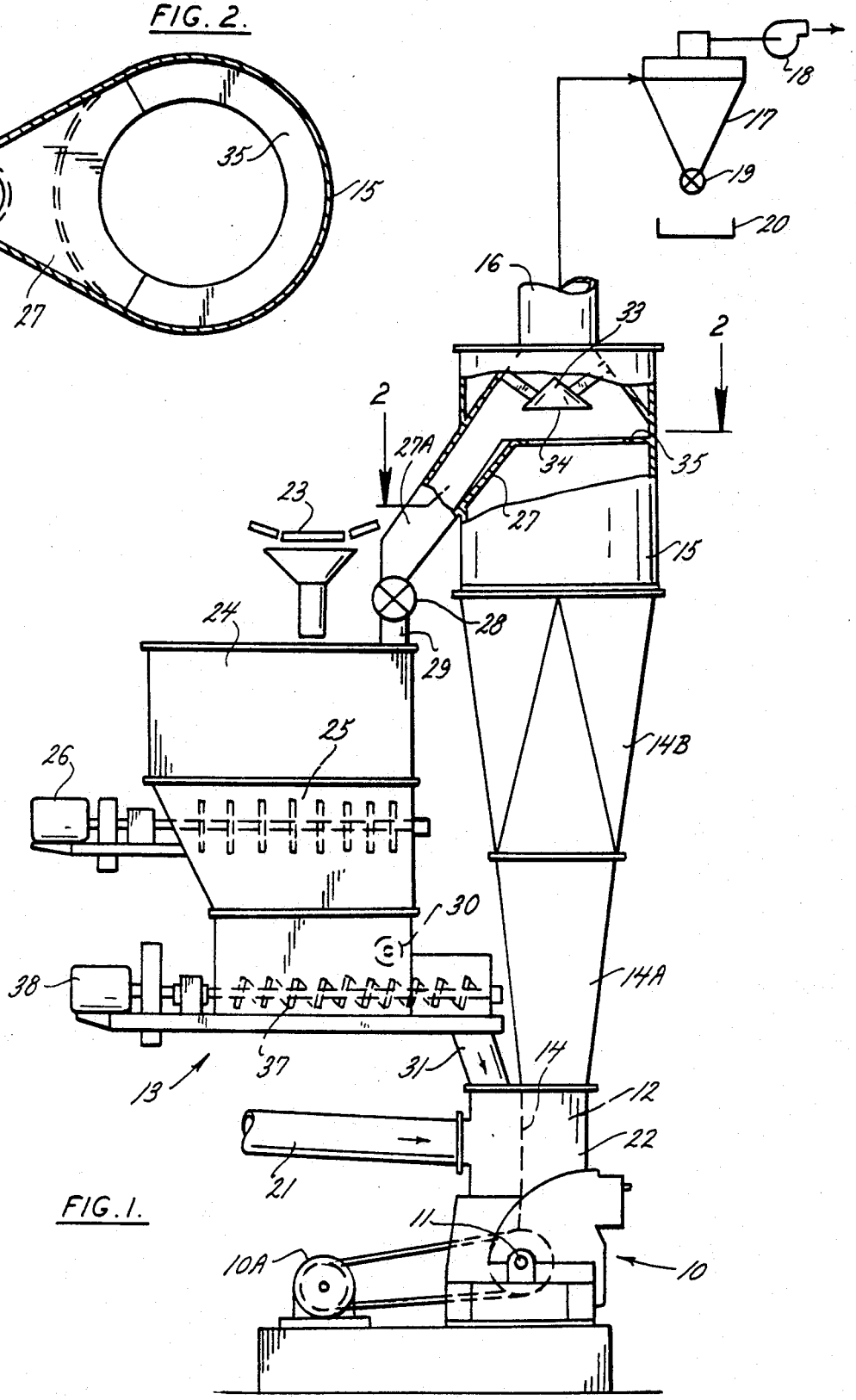
FIG. 1.

APPARATUS FOR AND A METHOD OF DISPOSING OF WET SLUDGE

BACKGROUND OF THE INVENTION

1. Field of the Invention

This invention is directed to the processing of a wet sludge with a drying medium obtained from the wet sludge after having the moisture substantially reduced to constitute the drying medium, and to apparatus for carrying out the process.

2. Description of the Prior Art

In the field of the disposal of wet sludge material which may include paper sludge as a result of the deinking process, human sewage or similar make-up of sludge which has a wetness of an order that causes it to clump-up and plug apparatus intended to facilitate its disposal, a sludge disposal system is seen in Williams U.S. Pat. No. 5,018,456 of May 28, 1991. In that patent the sludge forms a primary source of fuel for use in a furnace which produces hot gas for drying the sludge material, however, the apparatus depends on recycling some sludge, after being reduced, for use as a drying medium for the incoming sludge.

There is a great need for a way of disposing of wet sludge, but the difficulty is that sludge in its wet condition clumps up and moves as a spongy mass that resists normal efforts to break up and divide the sludge so the reduction in the moisture binder will allow the solids to separate sufficiently to encourage drying. The usual operation of prior art apparatus is to dry the sludge by recirculating the dried output which reduces the total output of the apparatus by the amount recycled, and no increased horsepower is required.

BRIEF SUMMARY OF THE INVENTION

It has been found that under certain conditions, in the operation of apparatus for grinding the sludge, portions of the ground output can act as a fuel to produce heat at a sufficient temperature level to become effective as a source of drying heat.

It is, therefore, an object of the invention to subject the flow of disposable ground sludge material to a supply of heat where only the heated coarse granular fractions are diverted from the fine fractions and circulated into the incoming wet sludge as a drying agent to perform an important function which changes the tendency of the wet sludge to clump and causes it to form a loose nearly homogenized flow in preparation for a grinding step without plugging the grinding apparatus and without reducing the output capacity.

An object of the invention is to process a mix of wet sludge and coarse fractions produced during the grinding of the mix in a hot atmosphere wherein a grinding mill forceably throws its output into a classifier so the material impacts against a target surface which intercepts the heated coarse fractions, while allowing the fine fractions to escape, and directs the heated coarse fractions into incoming wet sludge for initiating a moisture reducing function on the incoming wet sludge.

Another object of the invention is to establish a grinding mill outflow of heated ground material normally consisting of coarse and fine fractions and to provide a way of scalping off the coarse fractions so that substantially fine fractions are discharged as a product to be employed as fuel in a furnace which then can generate a source of heat for moisture reduction, or for other purposes, while the hot coarse fractions are circulated into the incoming wet sludge to overcome the clumping tendency and promote drying.

A further object of the invention is to process a wet sludge of the character indicated in apparatus that initially breaks up the formation of clumps or clusters of sludge so it is rendered relatively easy to grind and thereby produce a mixture of coarse and fine fractions, and to recirculate only the coarse fractions into the incoming wet sludge to reduce clumping of the wet sludge while collecting only the fine fractions for use in a furnace which produces heat to initiate drying of the wet sludge during the grinding thereof.

The invention includes a method for disposing of wet sludge by utilizing coarse fractions to mix into the sludge so as to reduce the quantity of material that usually falls back to the mill in direct counterflow against the product output from the mill; thereby effecting a reduction of horsepower needed for grinding, and using the separated fine fractions as fuel to develop drying heat.

The foregoing and other objects will be set forth in greater detail as the description proceeds.

BRIEF DESCRIPTION OF THE DRAWINGS

The following drawings represent the preferred mode of the invention, and wherein:

FIG. 1 is a schematic diagram of components of apparatus which renders the invention practical;

FIG. 2 is a fragmentary sectional view taken along line 2—2 in FIG. 1 of the apparatus for scalping coarse fractions from the output of a grinding mill seen in FIG. 1;

DETAILED DESCRIPTION OF THE PREFERRED EMBODIMENT

Figure 3:
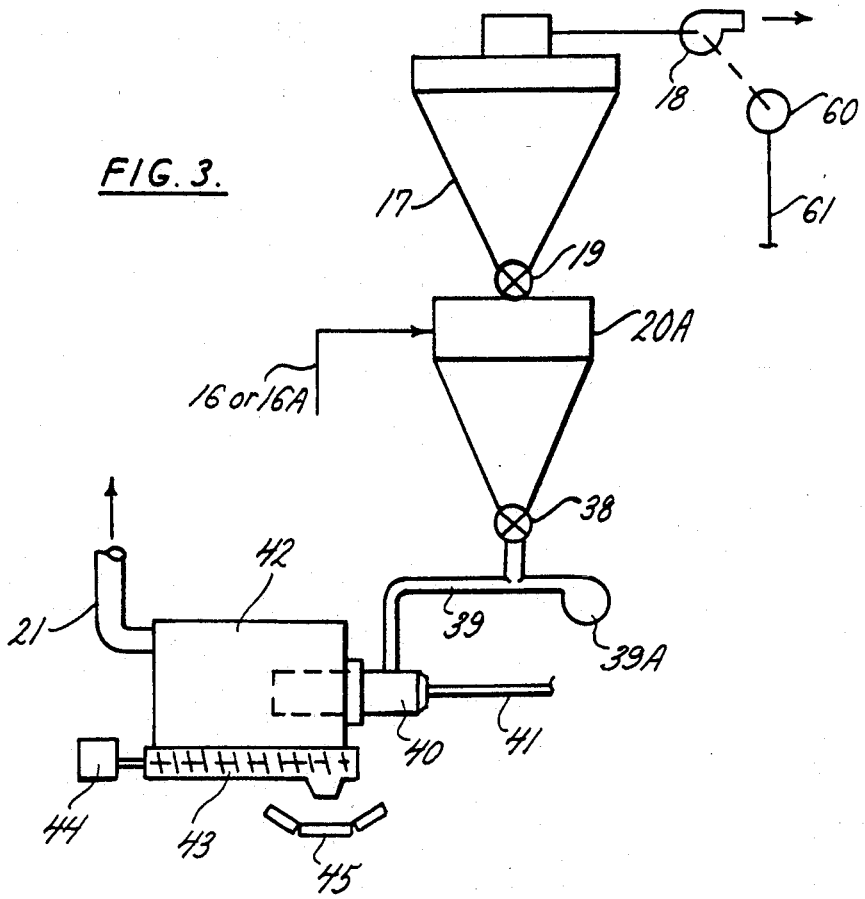
FIG. 3 is a schematic view of a furnace for utilizing the fine fractions as a fuel for drying purposes.

Looking at the schematic view of FIG. 1, the embodiment includes a material grinding mill 10 which may be a hammer mill driven by a suitable motor 10A belt connected to the rotor shaft 11 to drive that rotor in a counter clockwise direction so material entering the mill housing 22 from a feed delivery conduit 31 at one side of a partition 14 is ground and then projected or thrown upwardly-through the outlet passage 12 then into a stack made up of sections 14A and 14B. The stack extension 14B terminates in a separator casing 15 which is connected to an exhaust conduit or stack 16 leading to a cyclone separator 17 associated with a blower 18 which draws off the fine fractions along with gases and air from the casing 15. The cyclone separator 17 discharges the fine fractions through a rotary gate for discharge into a bin or other collector 20 for disposal as a fuel. A suitable source of hot drying gases is delivered by pipe 21 to the mill housing 22 to supply the heat into the incoming wet sludge for reducing the moisture in the same.

As seen in FIG. 1, wet sludge material is brought to the apparatus by a suitable belt or other conveyor 23 and dropped into the housing 24 and from there it falls into a flail agitator rotor 25 driven by motor means 26. The agitator can be a J. C. Steele, Stateville, N.C., Model No. 2030E Mixer, or the equivalent. The wet sludge is severely agitated to improve mixing and minimize clumping. The separator casing 15 is provided with a coarse material collecting chute 27 which directs the material into discharge conduit 27A connected through an airlock device 28 conduit 29 opening to the housing 24. In this manner, the heated coarse fractions, to be described presently, can be delivered to the housing 24 where it is severely agitated and intermingled with the wet sludge to initiate moisture reduction of the wet sludge. In the process of being severely mixed, the combined sludge and coarse fractions are deposited in a motor operated spiral screw feeder 37, such as a Stateville, N.C., Model EVEN FEEDER, No. 88C, or an equivalent. The feeder 37 has a cross-feed screw shaft 30 which is motor driven (not shown) to collect the material and concentrate it into a discharge conduit 31 opening into the mill housing 22 to fall adjacent the inflow of hot gases and air from conduit 21.

Referring now to FIGS. 1 and 2, it is seen that the casing 15 carries a target plug 33 in the axis of the casing 15 to present an impact surface 34 against which material thrown up from the mill 10 impinges. That impinging material is caused to collect on a circumferential shelf 35 positioned in the casing 15 at an elevation below the level of the impact surface 34. The rising column of gas and air which carries a mix of coarse and fine fractions is forced to travel laterally to get around the plug 33, and in so doing the coarse fractions are thrown out and into the chute 27 while some of the coarse fractions accumulate on the circumferential shelf 35. In this arrangement the fine fractions are not seriously impeded but move around the plug 33 and into the conduit 16 by the suction effect of the blower 18 associated with the cyclone separator 17.

The casing 15 (see FIG. 2) has its shelf 35 interrupted by a chute 27 which opens into a conduit 27A which directs the coarse fractions toward the rotary air lock 28. It is necessary to rotate an air lock to allow the coarse material to pass by a gravity fall into the conduit 29, otherwise the blower 18 would pull a negative pressure in conduit 29 to prevent an effective passage of the heated coarse fractions into the wet sludge in housing 24.

The schematic diagram in FIG. 3 illustrates means for collecting the fine fractions from the outlet conduit 16 by the action of the blower 18 which draws the fines into the cyclone separator 17 where the fines pass out into a bin 20. Alternately the fines may be released through a bin 20A through a rotary gate 38 to be conveyed in an air stream conduit 39, under the power of a blower 39A, to the burner head 40 for a furnace. The fines function as a fuel to aid the supply of a suitable fuel from a supply source 41. Under certain conditions the quantity of fine fractions can make up the largest source of fuel. In start up of the apparatus, a suitable fuel is used to raise the system to operating temperature levels. A suitable furnace 42 produces a supply of hot gaseous medium at conduit 21 which, as seen in FIG. 1, connects into the housing 22 to supply heat at a temperature of the order of 1500° F. The ash from the furnace 42 is discharged into a collector type grate 43 which is operated by motor 44, and the accumulation is carried off by a suitable conveyor 45.

Figure 4:
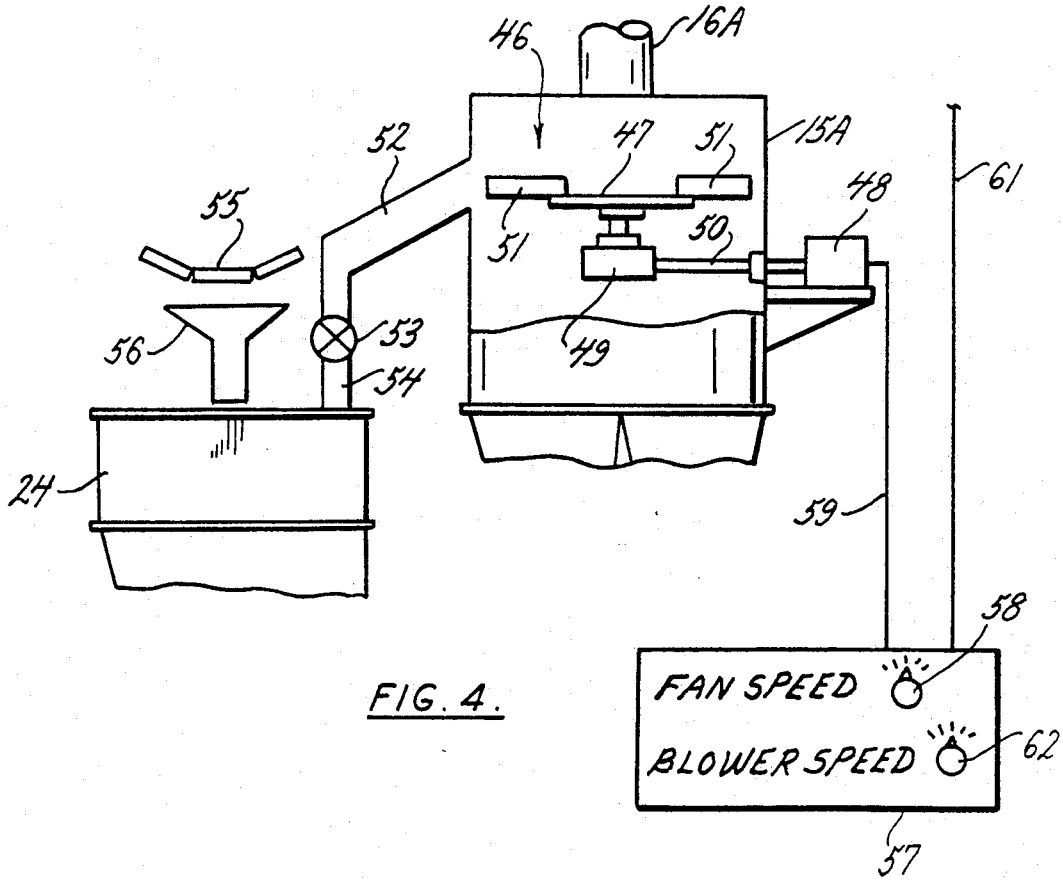
FIG. 4 is a modified classifier portion of the apparatus.

An alternate form of apparatus is seen in FIG. 4 wherein the classifier or separator casing 15A that is modified from that seen in FIG. 1. The modification embodies a spinner separator 46 in the form of a rotor disc 47 driven by a motor 48 through a suitable gear box 49 and drive shaft 50. The spinner separator 46 has two or more blades 51 which move in a circular orbit at about the elevation of a discharge conduit 52. The action of the blades 51 is to drive the oversize fractions into the conduit 52 while allowing the lighter fine fractions to impact on the center disc 47 and pass around and through the orbit of the blades 51 and exit at outlet conduit 16A, as before. The conduit 52 connects into a rotary gate 53, and that gate releases the coarse and overweight fractions to pass through conduit 54 and mingle with the wet sludge arriving by belt conveyor 55 at the inlet means 56 for the housing 24. The view of FIG. 4 is only fragmentary, as what is not shown is like the apparatus seen in FIG. 1.

The view of FIG. 4 is seen to include a control center 57 having a fan speed control 58 for the spinner separator motor 48 through control lead 59. There is also a motor 60 connected to the blower 18 and a control lead 61 from the motor 60 to a speed control 62. The control center 57 is useful to select the dynamics in the apparatus as between the draw in the casing 15A and the feed rate to conduit 52 under the speed of the motor 48. There is a need to match the feed of the hot coarse fractions into the casing 24 with the evacuation of the fine fractions by blower 18 and delivered to the furnace 42.

In the operation of the foregoing apparatus, the hot gases and air at a temperature of about 1500° F. from a furnace (not shown) are supplied through conduit 21. The apparatus is brought up slowly to a temperature of the order of about 540° F. as measured at the outlet conduit 16. The wet sludge brought by the conveyor 23 is usually at about 62% water for paper sludge and 80% for sewage sludge, and as it is mixed by the flailing means 25, the drying effect initiated by the coarse fractions is to reduce the moisture condition of the mixture of sludge and coarse fractions to about 40% to 50% water content. To obtain this degree of drying effort it is intended that the rate of feed of wet sludge needs to be coordinated with the feed of the coarse fractions in conduit 29 by the rate of rotation of the air lock rotor 28 to get the moisture reduction down to about 40% to 50% water content level in the feeder 13. An example of this control may be exemplified by feeding wet sludge at the rate of ten tons per hour, and feeding back the coarse recycled fractions at conduit 29 at a rate of about five tons per hour.

The mixing of the wet sludge and coarse fractions takes place in the mixer 25 and then drops down into the multi-screw feed device 13. That device 13 is equipped with a plurality of screw devices 37 driven by motor 38 which advances the mixed sludge and coarse fractions toward the cross collector screw 30 driven by motor (not shown) to collect the advancing mix and direct it into the discharge conduit 31.

The system described above is placed in operation by supplying heat from a gas burner source through the hot gas pipe 21 at about 1500° F. at a very slow rate to bring the apparatus, and particularly the exhaust stack 16, up to a substantially uniform temperature of about 500° F. Thereafter, the wet sludge is slowly introduced during a predetermined residence time to the sludge housing 24 and feed device 13 and allowed to pass through the turbulance of the mixer 25 and down into the bottom feed device 13 where it is discharged at conduit 31 into the grinding mill 10 through the hot gas from conduit 21 which is at a temperature of about 1500° F. The mill 10 throws the material in a flow of the heated ground sludge upwardly through the mill stack 14A, stack extension 14B and into the separator casing 15 where separation of the heated coarse product from the fine product takes place due to the suction effect of the blower 18 associated with the cyclone separator 17. As the system continues, the course fractions are mixed with the wet sludge in the housing 24 by the operation of the flail rotor 25 so that the mixed material moves into the bottom feed device 13 establishing the operating system at the defined rate for disposing of the wet sludge in the manner set forth, and selectively using the fine fractions separated at the cyclone separator 17 as a useful product or as a fuel to augment the production of the hot gas supplied to the grinding mill 10 through conduit 21.

The foregoing apparatus performs the steps of a unique method for disposing of wet sludge resulting from the discarding of deinking sludge from paper plants, and human waste sewage sludge, both of which are rapidly becoming an environmental hazard. The unique method in a broad form is adapted to employ drying material in a transformation form as the medium to dry the wet sludge and render the wet sludge flowable as a composite material, subjecting the composite material to a step of converting that composite material into coarse and fine fractions in the presence of drying heat, thereby making it possible to remove the coarse fractions from the air stream to thereby employ the coarse fractions as the drying material to be mixed with the wet sludge, while collecting the fine fractions as a product of the method. The method can be continued at whatever rate is determined that will successfully dispose of the wet sludge.

The apparatus disclosed in the drawings is easily capable of rendering the method applicable to a high rate of disposing of the wet sludge.

The steps of the foregoing method, practiced by the apparatus comprises supplying heat to a grinding mill at the same time as a movement of the wet sludge through a mixer uses recirculated heated coarse fractions of the sludge that are not entirely reduced by grinding as a drying medium to reduce the wetness of the incoming sludge for improving the grindability of the mix of sludge and coarse fractions while reducing the horsepower and not impeding the mill output. The practice of this unique method is greatly facilitated by an arrangement of apparatus capable of processing the wet sludge and the resulting mixing of the sludge and heated coarse fractions of the ground sludge output from a mill so that a substantial disposal of large quantities of the objectionable sludge can be effected.

It is appreciated from the foregoing disclosure that modifications may come to mind that are essentially the equivalent in scope and result herein disclosed.

What is claimed is:

1. Apparatus for subjecting the flow of disposable wet sludge material to moisture drying heat to change the tendency of wet sludge to plug the inlet to a material grinding system for preparing the sludge for disposal, the apparatus comprising:

a) a sludge grinding means having an inlet and an outlet;

b) classifier means connected to said grinding means outlet, said classifier means providing a chamber in which coarse sludge particles are separated from fine particles;

c) outlet means connected to said classifier chamber for diverting the coarse sludge particles;

d) a source of wet sludge material;

e) a system for preparing the sludge for disposal, and including in said system:

1) housing means having a first inlet to receive diverted coarse sludge particles, and a second inlet for receiving wet sludge material;

2) agitation means in said housing for comingling the wet sludge material and coarse sludge particles;

3) means connecting said housing to said sludge grinding means for directing the comingled wet sludge and coarse sludge particles into said sludge grinding means; and 4) a source of heat connected into said sludge grinding means to introduce drying heat to the wet sludge and coarse sludge during grinding thereof for changing the tendency of the wet sludge to plug said sludge grinding means.

2. The apparatus set forth in claim 1 wherein means for scalping off coarse sludge particles and passing ground fine fractions is operative in said material classifying means.

3. The apparatus set forth in claim 1 wherein said classifying means includes means for collecting coarse sludge particles in position to be directed into said housing means.

4. Apparatus for disposing of moisture containing sludge material comprising:

a) a source of wet sludge material;

b) means for grinding the moisture containing sludge material in the presence of a supply of moisture reducing heat;

c) outlet conduit means connected to said means for grinding the heated moisture containing sludge;

d) means in said outlet conduit means for stripping heated fine fractions of the ground material and collecting oversize heated ground fractions;

e) means for combining the collected oversize heated ground fractions with the wet sludge material for changing the tendency of the wet sludge to plug said means for grinding the moisture containing sludge material; and f) means for separately collecting the stripped fine fractions.

5. A method of disposing of wet sludge by employing the wet sludge in a transformation form as the medium to dry the wet sludge and produce a product therefrom, the method comprising the steps of:

a) mixing wet sludge material with a coarse heated drying material for intermixing to render the wet sludge flowable by the drying material as a composite material suitable for reduction;

b) subjecting the composite material following the intermixing to a grinding step of converting the composite material into coarse fractions and fine fractions;

c) introducing heat into the step of converting the composite material such that the coarse and fine fractions constitute drying materials;

d) employing the coarse fractions as the source of the drying material for the first mentioned step; and e) collecting the fine fractions independently of the wet sludge as a product derived from the drying material.

6. The method set forth in claim 5 wherein the steps are substantially followed in the sequence set forth in the claim.

7. The method set forth in claim 5 wherein the converting of the composite material is continued at a rate effective to employ it to reduce the percentage of moisture contained in the wet sludge.

* * * * *